United States Patent [19]

Donoff

[11] 3,991,458

[45] Nov. 16, 1976

[54] APPARATUS FOR USE IN REPAIRING ROLLS SUPPORTING WEB MATERIAL

[75] Inventor: Richard C. Donoff, Richmond, Va.

[73] Assignee: Philip Morris Incorporated, New York, N.Y.

[22] Filed: Sept. 17, 1975

[21] Appl. No.: 614,084

[52] U.S. Cl. ..... 29/234; 29/282; 242/81

[51] Int. Cl.[2] ..... B23P 19/02

[58] Field of Search ..... 29/234, 235, 278, 280, 29/282; 242/81

[56] References Cited

UNITED STATES PATENTS

| | | | |
|---|---|---|---|
| 3,083,449 | 4/1963 | Simmons | 29/282 |
| 3,564,695 | 2/1971 | Willis et al. | 29/234 |

*Primary Examiner*—Al Lawrence Smith
*Assistant Examiner*—Roscoe V. Parker
*Attorney, Agent, or Firm*—Watson Leavenworth Kelton & Taggart

[57] ABSTRACT

Apparatus for replacing a damaged core having web material wound thereabout comprises an elongate fixture having longitudinally aligned separably stackable sections, one fixture section having configuration in part facilitating insertion of the fixture within the damaged core and in other part displacing the damaged core outwardly of the wound web material on longitudinal fixture movement and the other fixture section having configuration in part supporting a replacement core thereon and in other part inserting the replacement core within the wound web material.

7 Claims, 5 Drawing Figures

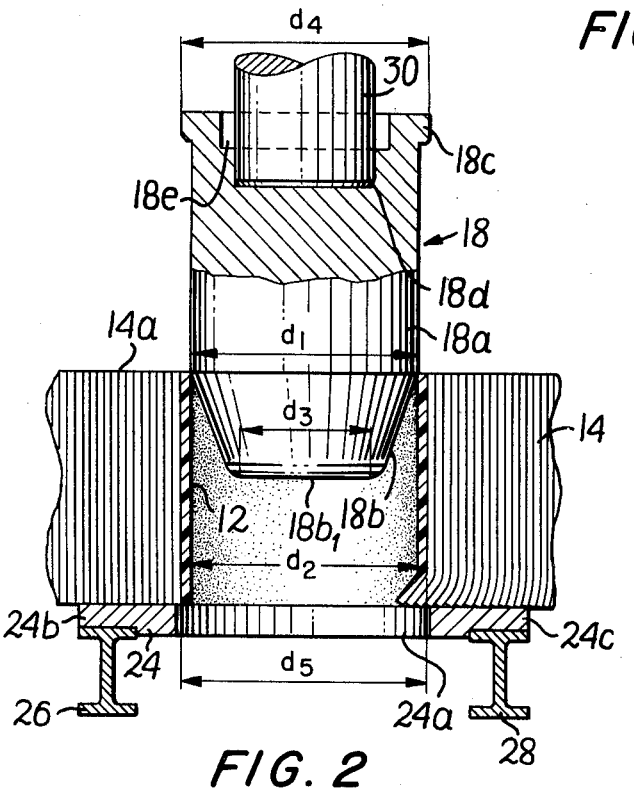
FIG. 2
FIG. 3
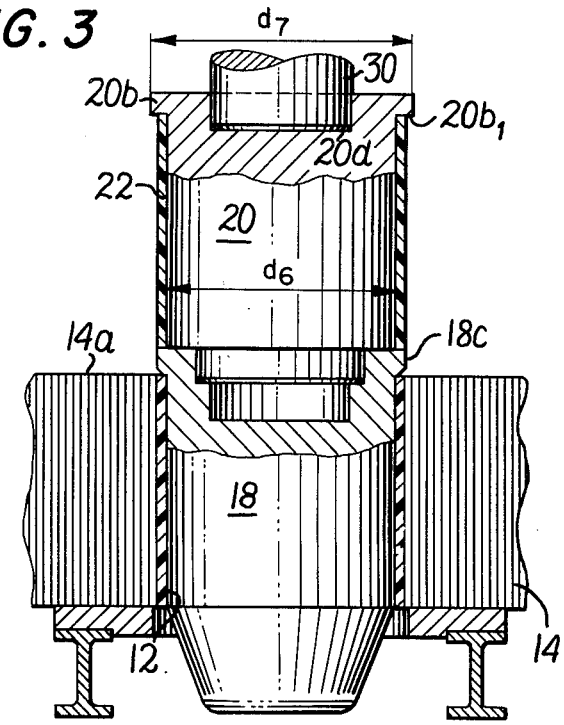
FIG. 5
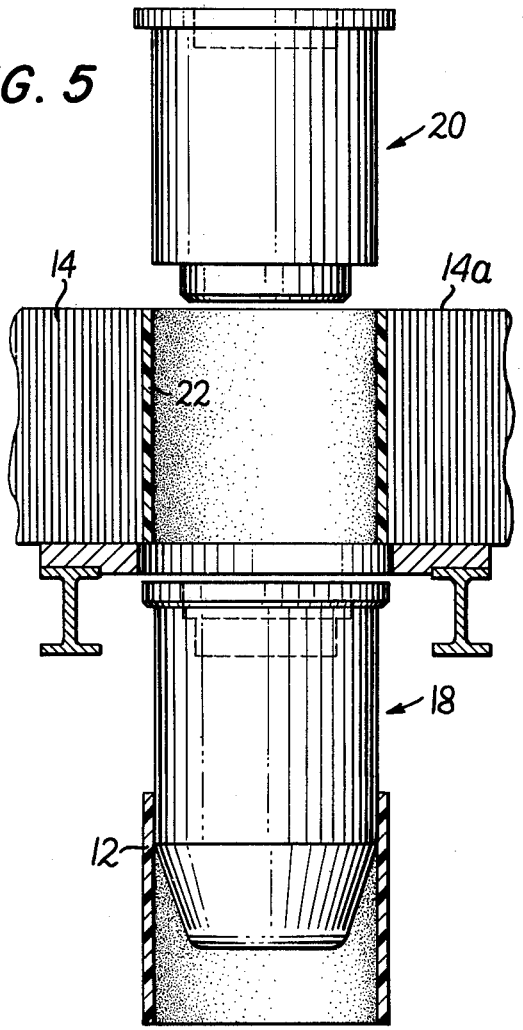
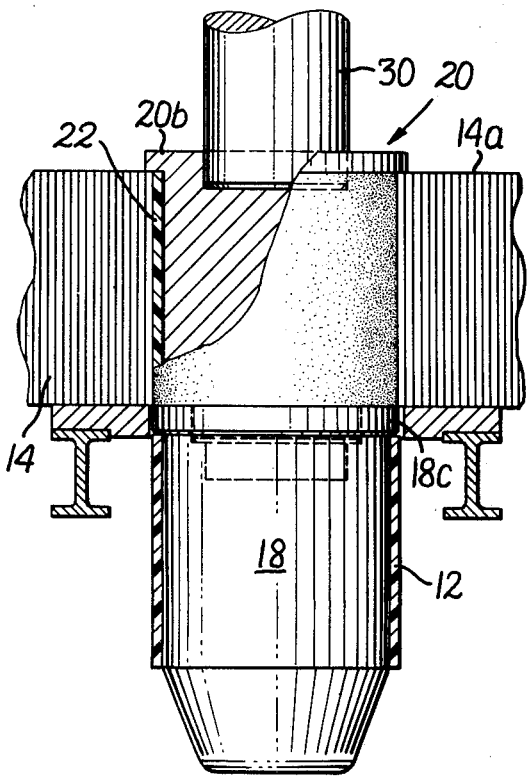
FIG. 4

APPARATUS FOR USE IN REPAIRING ROLLS SUPPORTING WEB MATERIAL

FIELD OF THE INVENTION

This invention relates to apparatus for use in repairing roll assemblies of type having a core with web material wound thereabout.

BACKGROUND OF THE INVENTION

In the course of the handling or use of rolls of paper or other continuous web material wound about a core, the relatively heavy weight of the wound material frequently occasions damage to the core. The core material, typically paperboard or cardboard, is not particularly rigid and the core may be permanently deformed or so weakened as to render a roll unusable after being dropped or otherwise mishandled.

To avert the need for costly discarding of rolls having damaged cores, past practices have involved efforts to repair the damaged core or to modify roll handling machinery such that the roll can be used thereon despite its damaged core. In the former practice, cores have sometimes been straightened manually by driving a metal mandrel fully into the core and then removing the mandrel. This operation is time consuming and the straightened cores are sometimes so weakened that they collapse. In the latter practice, the conventional bobbin on which undamaged rolls are used is replaced by so-called "core stretcher". The stretcher is of lesser diameter than the bobbin diameter and, on receipt of the damaged roll, the stretcher is mechanically radially expanded to frictionally grip the damaged core. While the damaged roll may now be used on such core stretcher, this practice requires that at least one machine in each production line be equipped with a core stretcher and that all damaged rolls be run on that machine. So equipping a production line is costly and, even then, not all damaged rolls can be salvaged. Thus, rolls which cannot be accommodated by the core stretcher are unusable.

SUMMARY OF THE INVENTION

It is an object of the present invention to provide improved apparatus to repair rolls having damaged cores.

In attaining the foregoing and other objects, the invention provides apparatus comprising a fixture having separably stackable sections employable to substitute a replacement core for a damaged core. One section of the fixture serves to displace the damaged core outwardly of the roll and, in the course of such damaged core displacement, the other fixture section, which carries a replacement core, advances the replacement core into operative position in the roll.

The foregoing and other objects and features of the invention will be evident from the following detailed description of a preferred embodiment thereof and from the drawings wherein like reference numerals identify like parts throughout.

DESCRIPTION OF THE DRAWINGS

FIGS. 2–5 are schematic illustrations showing successive stages of use of the FIG. 1 fixture.

DESCRIPTION OF THE PREFERRED EMBODIMENT

Figure 1:
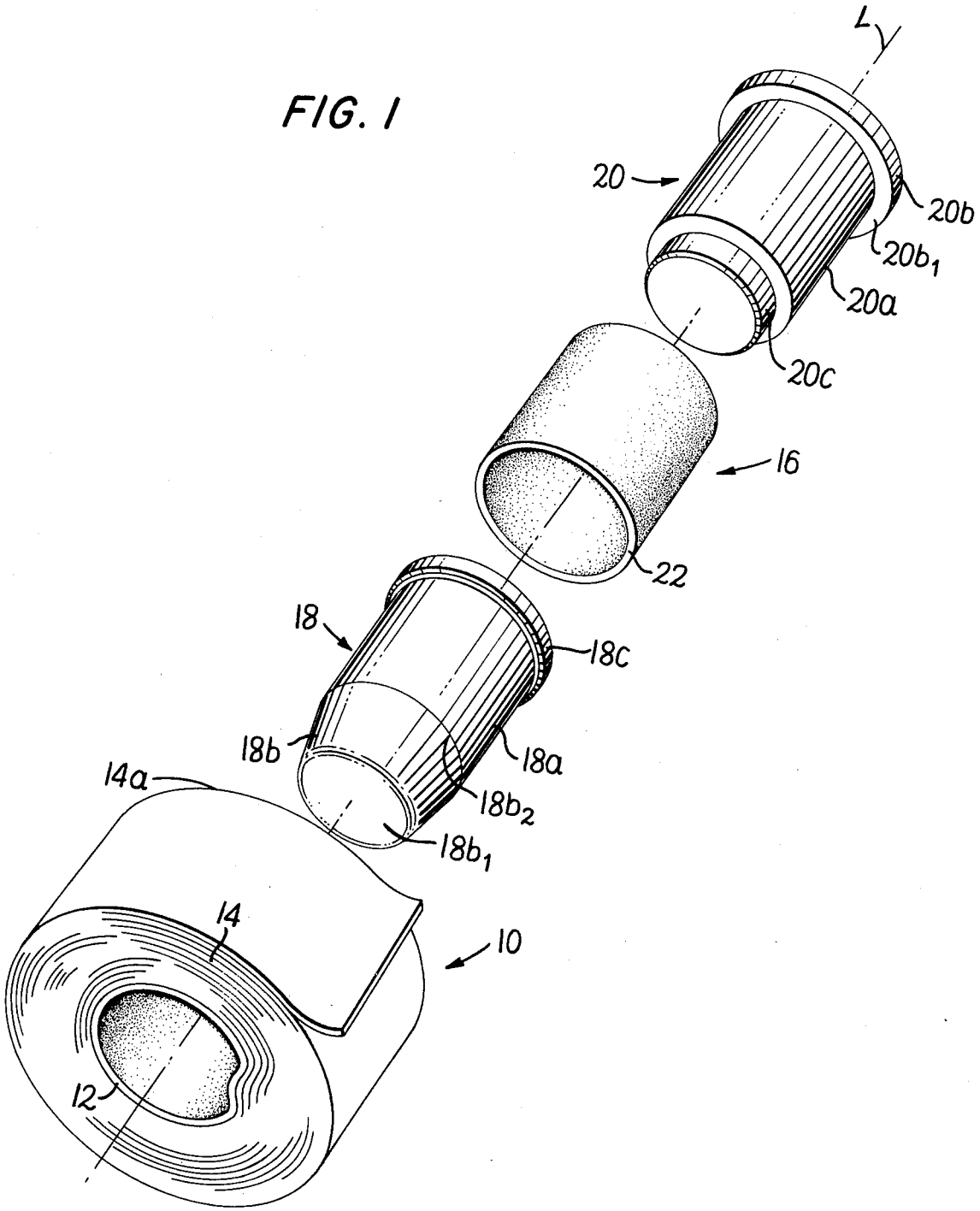
FIG. 1 is a perspective view illustrating a fixture in accordance with the invention in exploded manner and a roll to be operated upon thereby.

Referring to FIGS. 1–3, roll assembly 10 includes a core 12, formed of paperboard, cardboard or other such moderately sturdy support material subject to damage in handling. A continuous web 14 of paper or paper-like material, such as is used in labeling and packaging of goods and like operations, is wound or wrapped on core 12. Fixture 16, used in replacing such assembled core in accordance with the invention, is elongate along axis L and includes a core straightening and removing element 18, termed a mandrel, and a carrier 20 for receiving replacement core 22 and inserting the latter within web material 14 as a substitute for the damaged core. Both mandrel 18 and carrier 20 are preferably comprised of aluminum or other rigid lightweight material.

Body portion 18*a* of mandrel 18 has a cylindrical outer surface of diameter $d_1$ the same or slightly less than the inner diameter $d_2$ of core 12. Tapered leading portion 18*b* of mandrel 18 is of configuration permitting free entry thereof within core 12, and as shown in FIG. 1, is preferably of rounded frustro-conical shape extending from end surface 18$b_1$ of diameter equal to that of the outer surface of body portion 18*a* to a rounded opposite end surface 18$b_2$ whose diameter $d_3$ is substantially reduced from that of body portion 18*a*. By this arrangement of mandrel portions 18*a* and 18*b*, the mandrel may be readily inserted within a core exhibiting damage such as shown in broken lines in FIG. 1. Upon complete insertion of the mandrel in core 12, body portion 18*a* forces the core into its original configuration whereupon trailing mandrel portion 18*c* will abut against the core. Portion 18*c* of the mandrel defines an outer cylindrical surface having a diameter $d_4$ in excess of the inner diameter $d_2$ of core 12 but less than the inner diameter $d_5$ of web material 14.

Replacement core 22 is of the same dimensions as core 12 and is generally formed of like cardboard material. In instances wherein core 22 is to replace a core in a roll so distorted as to in turn tend to distort the replacement core, the invention contemplates the use of material, e.g., fiberglass or the like, which is more rigid than the material constituting the replaced core. Carrier 20 has a body portion 20*a* circumscribed by a cylindrical surface of outer diameter $d_6$ the same or slightly less than the inner diameter of core 22 whereby core 22 may be slidably received by carrier 20 in encircling relation to its body portion 20*a*. When so disposed on carrier 20, core 22 abuts against carrier trailing portion 20*b* which has an outer cylindrical surface of diameter $d_7$ exceeding the inner diameter of core 22 and preferably also exceeding the inner diameter of the wound web material 14. Carrier 20 further incorporates a leading portion 20*c* of diameter less than the outer surface of body portion 20*a* and adapted to interfit with a complementary-shaped longitudinal cavity in mandrel 18, as discussed below.

Roll assembly 10 is disposed as indicated in FIG. 2 atop a supporting base plate 24 having a central aperture 24*a* of diameter exceeding that of the outer diameter of core 12. The base plate may have peripheral reduced thickness portions 24*b* and 24*c* and thus provide on its undersurface notched recesses by which plate 24 may be supported by beams 26 and 28. Mandrel 18 is used initially without the remainder of fixture 16 and ram 30 of a press having a stroke exceeding the length of core 12 is inserted in longitudinal cavity 18*d*, accessible outwardly of mandrel trailing portion 18*c*. The mandrel is urged by the ram into its FIG. 2 position wherein the mandrel leading portion 18*b* is disposed symmetrically interiorly of core 12.

At this juncture, ram 30 is removed from mandrel 18. Carrier 20 with replacement core 22 assembled therewith, is now stacked atop mandrel 18 with carrier leading portion 20*c* inserted in longitudinal cavity 18*e* accessible outwardly of mandrel trailing portion 18*c* as shown in FIG. 3. Ram 30 is now inserted in longitudinal cavity 20*d* accessible outwardly of trailing portion 20*b*.

On further operation of ram 30, as shown in FIG. 3, mandrel body portion 18*a* is driven within core 12 until mandrel trailing portion 18*c* abuts against core 12. Ram 30 is now further operated, as shown in FIG. 4, whereby mandrel trailing portion 18*c* is driven through web material 14 until the undersurface $20b_1$ of carrier trailing portion 20*b* is substantially coplanar with the upper surface 14*a* of wound web material 14. In this operation, core 12 is displaced outwardly of wound web material 14 and, in the course thereof, replacement core 22 is introduced interiorly of the wound web material. As shown in FIG. 5, mandrel 18 may now be separated from carrier 20, the latter being withdrawn upwardly from the repaired roll and the former carried downwardly outwardly from the repaired roll. Damaged core 12 is then slipped from mandrel 18 and discarded.

In its particularly preferred embodiment, carrier trailing portion 20*b* of fixture 16 has outer surface diameter $d_7$ exceeding inner diameter $d_5$ of web material 14 whereby body portion 20*b* abuts against web material upper surface 14*a* as shown in FIG. 4. By this arrangement, longitudinal axially downward movement of carrier trailing portion 20*b* in FIGS. 3 and 4 is limited by the web material itself, i.e., such portion 20*b* cannot enter interiorly of the web material. This arrangement dispenses with the need for observing coplanar relation as between undersurface $20b_1$ of carrier trailing portion 20*b* and web material surface 14*a* in registering replacement core 22 with the wound web material.

By the expression "the same or slightly less" employed above to characterize the diameters of both mandrel body portion 18*a* and carrier body portion 20*a*, there is meant a diameter for these body portions which permits sliding relationship as between mandrel body portion 18 and core 12 and as between carrier body portion 20*a* and replacement core 22 while yet providing sufficient proximity of the outer cylindrical surface of these body portions to the respective cores to prevent buckling or other radially inward movement of the cores as they are respectively removed from and inserted into web material 14 by fixture 16.

Various changes and modifications to the foregoing particularly described embodiment of the invention will be evident to those skilled in the art and may be made without departing from the invention. For example, the trailing body portions of the mandrel and carrier elements may constitute caps thereon or flanges of dimension above discussed and integrally formed with the remaining portions of these elements, which may be made solid or hollow in fabrication. Accordingly, the illustrated preferred embodiment is intended in an illustrative and not in a limiting sense. The true spirit and scope of the invention is set forth in the following claims.

What is claimed is:

1. Apparatus for substituting, for a tubular core assembled with web material wound radially thereabout, a replacement core of the same dimensions as said tubular core, said apparatus comprising an elongate fixture having longitudinally aligned mandrel and core carrier elements, said mandrel element having a leading portion freely insertable in such assembled core, a body portion having a cylindrical outer surface of diameter the same or slightly less than the inner diameter of said assembled core and a trailing portion having a cylindrical outer surface of diameter exceeding the inner diameter of said assembled core but less than the inner diameter of said web material wound thereabout, said carrier element being separably stackable on said mandrel element and having a body portion with a cylindrical outer surface of diameter the same or slightly less than the inner diameter of said assembled core and a trailing portion of diameter exceeding the inner diameter of said assembled core whereby said replacement core may be received circumferentially on said carrier element body portion prior to stacking of said carrier element on said mandrel element, said mandrel trailing portion displacing said assembled core from said wound web material and said carrier element trailing portion displacing said replacement core interiorly of said wound web material upon longitudinal translation of said fixture into said wound web material.

2. The apparatus claimed in claim 1 wherein said cylindrical outer surface of said core carrier element trailing portion is of diameter exceeding said inner diameter of said wound web material.

3. The apparatus claimed in claim 1 wherein said mandrel element defines a longitudinal cavity accessible outwardly of said trailing portion thereof, said carrier element including a leading portion extending longitudinally outwardly of said body portion thereof and insertable in said mandrel element cavity whereby said carrier element is longitudinally axially separably stackable on said mandrel element.

4. The apparatus claimed in claim 1 wherein said carrier element defines a longitudinal cavity accessible outwardly of said trailing portion thereof, said apparatus further including press means insertable in said carrier element cavity for longitudinally displacing said fixture into said wound web material.

5. The apparatus claimed in claim 1 further including means for supporting said assembled core and wound web material, such support means having an opening of cross-sectional dimensions exceeding the outer diameter of said assembled core.

6. The apparatus claimed in claim 1 wherein said mandrel element leading portion is of rounded frustroconical configuration, having one end surface of diameter equal to that of said mandrel element body portion and an opposite end surface of diameter less than that of said one end surface thereof.

7. Apparatus for removing a damaged tubular core from a roll of web material wound thereon and inserting a replacement core in said roll, said apparatus comprising a mandrel having an elongated body portion having a smoothly rounded part at one end thereof, there being a radially enlarged flange at the other end of said mandrel, the maximum dimension of said mandrel body portion being the same or slightly less than the inner dimension of the damaged core, whereby said mandrel body portion can be inserted into one end of the damaged core, the maximum dimension of said radially enlarged flange exceeding the inner dimension of said damaged core, press means for pressing said mandrel into said damaged core until said radially enlarged flange engages the end face of said one end of said damaged core, a core carrier having an elongated body portion and a radially enlarged cap at one end of said carrier body portion, the maximum dimension of said carrier body portion being less than the inner dimension of a replacement core, and the maximum dimension of said enlarged cap being greater than the inner dimension of said replacement core, said replacement core being carried on the main body portion of said carrier, the end of said carrier opposite said one end thereof being engageably receivable against said other end of said mandrel body portion, there being complementary-shaped interfitting structure at said other end of carrier and said other end of said mandrel for maintaining said carrier and mandrel in longitudinal axial alignment, said pressing means being operable when said carrier is received against said other end of said mandrel for unitarily longitudinally displacing said carrier, the replacement core carried thereon, and said mandrel whereby the damaged core is ejected from and the replacement core inserted into said roll.

* * * * *